United States Patent [19]

Shirai et al.

[11] Patent Number: 4,874,683

[45] Date of Patent: Oct. 17, 1989

[54] LIQUID DEVELOPER FOR ELECTROPHOTOGRAPHY

[75] Inventors: Miyuki Shirai; Akira Nogami, both of Hino, Japan

[73] Assignee: Konishiroku Photo Industry Co., Ltd., Tokyo, Japan

[21] Appl. No.: 241,832

[22] Filed: Sep. 6, 1988

Related U.S. Application Data

[63] Continuation of Ser. No. 893,026, Aug. 1, 1986, abandoned.

[30] Foreign Application Priority Data

Aug. 9, 1985 [JP] Japan ..... 60-176527

[51] Int. Cl.[4] ..... G03G 11/00; G03G 9/12

[52] U.S. Cl. ..... 430/114; 430/904; 430/115

[58] Field of Search ..... 430/114, 115, 904

[56] References Cited

U.S. PATENT DOCUMENTS

| | | | |
|---|---|---|---|
| 3,551,337 | 12/1970 | Robinson | 430/115 X |
| 3,669,886 | 6/1972 | Kosel | 430/115 X |
| 3,820,986 | 6/1974 | Fukushima | 430/126 X |
| 3,849,165 | 11/1974 | Stahly | 430/119 |
| 3,900,412 | 8/1975 | Kosel | 430/114 |
| 4,032,463 | 6/1977 | Kawanishi | 430/137 X |
| 4,259,429 | 3/1981 | Gilliams et al. | 430/124 |
| 4,415,644 | 11/1983 | Tomaki et al. | 430/111 X |

*Primary Examiner*—J. David Welsh

*Attorney, Agent, or Firm*—Jordan B. Bierman

[57] ABSTRACT

Disclosed is a liquid developer for electrophotography wherein the dispersed toner particles have a single peak distribution and the number of particles that are less than 0.06 μm is not greater than 5%, and not more than 3% of the particles are greater than 1.5 μm.

7 Claims, 1 Drawing Sheet

LIQUID DEVELOPER FOR ELECTROPHOTOGRAPHY

This application is a continuation of application Ser. No. 893,026, filed Aug. 1, 1986, now abandoned.

BACKGROUND OF THE INVENTION

The present invention relates to a liquid developer for electrophotography and more particularly to a liquid developer for electrophotography improved upon the reproducibility and quality of images obtained through a development and the dispersion stability of the developer.

Liquid developers are those carrying the so-called 'toner' which is dispersed in a solvent, so that image forming areas may be provided in such a manner that charged toners adhere to a latent image by electrophoresis, in the course of a development process. Such toner is, therefore, comprised of a statically chargeable substance such as a pigment or dyestuff particle capable of generating the above-mentioned electrophoresis and a resin capable of being absorbed to the particle and migrating together with the particle. Such a toner particle as mentioned above is to be so stable in the charge controllability thereof as to keep its charge constant and is to be excellent in the dispersibility and disperson stability thereof to a solvent used.

The toner particle sizes involve not only the resolving power of an image but also the sharpness, flowing characteristics of an image and the like to a great extent. Generally, the liquid developers are of the type of dispering resins containing such a colorant as pigments, dyestuffs or the like and, therefore, the particle sizes thereof have a certain extent of a wide distribution. However, not so careful attentions have so far been paid to the fact that an image quality differentiates in accordance with the conditions of the particle size distribution.

With the purpose of improving the above-mentioned dispersibility, dispersion stability and fixability. Japanese Patent Examined Publication Nos. 3696/1980 and 10195/1980; and Japanese Patent O.P.I. Publication Nos. 125333/1977 and 49445/1973 disclose that, in the liquid developers for electrophotography comprising a toner whose chief ingredients are a pigment or dyestuff and thermoplastic resin and a liquid carrier in which the toner is dispersed, an alkyl acrylate or alkyl methacrylate which is soluble in a non-aqueous solvent, or a copolymer of ethylene type unsaturated monomers which is hardly soluble or insoluble in the above-mentioned non-aqueous solvents, is added as the above-mentioned resin in a proportion of the range of from 95 to 60% by weight.

They are, however, not only unsatisfactory in the characteristics originally aimed at, but also not always excellent in the sharpness and flowing characteristics of the toner images produced with the developers.

With the purpose of obtaining a toner which is so excellent in mechanical strength and printing durability of toner images and in ink receptivity as to be capable of serving as a developer when a printing plate is prepared in an electrophotographic system, Japanese Patent Application No. 113644/1983 indicates that, in a liquid developer containing a toner chiefly comprising a pigment or dyestuff and a resin, a high molecular compound comprising a monomer component which is soluble in a non-aqueous solvent and another monomer component which is hardly soluble or insoluble in the non-aqueous solvent are contained therein in a proportion of from 5 to 55% by weight. This toner is, however, poor in dispersibility and dispersion stability and is apt to cause the flow of image, because it contains a lot of waxes and/or polyolefin, say, in a proportion of from 45 to 95% by weight.

As described above, the conventional types of liquid developers, is not satisfactory in dispersion stability, can hardly provide such a toner image as is excellent in image quality and, in particular, substantially less in image flow. The improvements thereof have, therefore, been demanded so far.

SUMMARY OF THE INVENTION

It is, accordingly, an object of the invention to provide an electrophotographic liquid developer capable of obtaining toner images substantially less in image flow and excellent in sharpness and image quality.

Another object of the invention is to provide an electrophotographic liquid developer excellent in dispersibility, storage stability and charge controllability.

A further object of the invention is to provide an electro-photographic liquid developer capable of producing a lithographic printing plate with an excellent printing durability.

It is known that the particles of liquid developers are relatively smaller in size than those of dry-type developers. It has not, however, been definitely proved that the quality of images will differentiate to a great extent in accordance with the toner particle size distribution. Such particle size distribution is one of the essential factors, inclusive of the composition and configuratin of toner particles, which have an influence upon such electrophysical properties as mobility, δ-potential and the like, and is also really important for obtaining an excellent image quality.

The object of the invention above-mentioned is accomplished by the liquid developer for electrophotography comprising a non-aqueous solvent and toner particles dispersed in said non-aqueous solvent, said particles comprising a colorant, a high-molecular compound containing therein a first monomer component which is soluble in said non-aqueous solvent and a second monomer component which is insoluble or hardly soluble in said non-aqueous solvent, and a thermoplastic resin which is insoluble or hardly soluble in said non-aqueous solvent at an ordinary temperature, wherein the number of the toner particles being less than 0.06 μm in size is not more than 5%, and the number of the toner particles exceeding 1.5 μm in size is not more than 3% of the total number of the toner particles.

DETAILED DESCRIPTION OF THE INVENTION

Particle sizes may be measured by various means including, for example, a particle size measuring instrument such as a Horiba's centrifugal type automatic particle size distribution measuring instrument, Model CAPA-500, manufactured by Horiba Mgf. Works, Ltd.

If the proportion of the particles of smaller than 0.06 μm in size is not less than 5% of the total particles, the sharpness of images may be worsened, and if the proportion of the particles exceeding 1.5 μm in size is not less than 3% of the total particles, the toner flow in image areas may remarkably be increased. It is further preferred that the upper limit of the relatively larger particle sizes is taken to 1.2 μm instead of 1.5 μm.

In order to manufacture the liquid developers having such a particle size distribution as mentioned above, it is advisable to apply the optimum conditions, in a trial and error method, for the pretreatment of a colorant, the mixing and kneading of a high molecular compound or a thermoplastic resin, the heating dissolution of the thermoplastic resin into a non-aqueous solvent and the quenching thereof (in which it is preferred to use a non-aqueous solvent containing a high molecular compound), the combination use of a high-speed dispersion and the like at a high viscosity of not lower than 1,000 cps, the dispersion process, a temperature to be applied, and the like.

Figure 1:
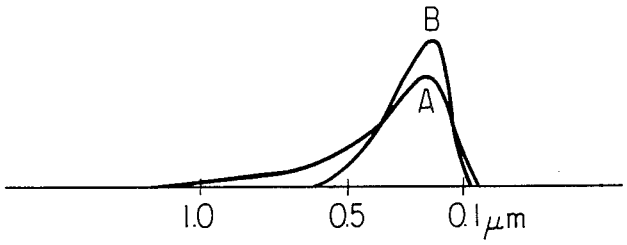
FIG. 1 illustrates a toner particle distribution preferable for the invention.
Figure 2:
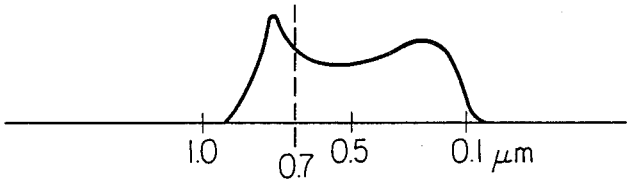
FIGS. 2 and 3 illustrate those not preferable for the invention, respectively.
Figure 3:
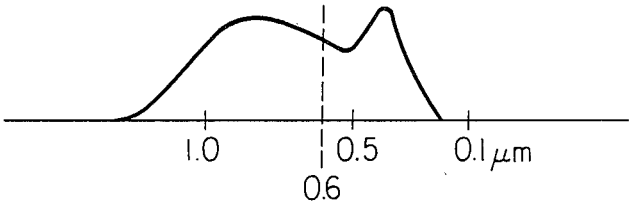

The preferable toner particle size distribution is a single peak distribution without having an abnormal protrusion, such as that shown in FIG. 1. The double-peak distributions shown in FIGS. 2 and 3 are given as the unacceptable examples. The breakup of the distribution peaks is apt to cause particularly when a cohesion of a part of toner particles is taken place by a lacking or uneven dispersion or a storage and, besides, such breakup is also caused in such a case that the above-mentioned various dispersion processes are not effectively applied. Should there be a serious breakup, it can not be solved at all, even if a dispersion process should continuously be applied. With a toner having a distribution containing two far-separated peaks, the image flow is apt to come out, the sharpness of characters is deteriorated, images are reproduced with stains in non-imaged areas and the preservability is also deteriorated.

The high molecular compounds applicable to the invention are capable of keeping both of the aforementioned coloring agents (a) and thermoplastic resins (c) dispersed stably in high insulating low dielectric constant non-aqueous solvents and, at the same time, such compounds constitute a component of a toner-image area and comprise a monomer component which is soluble in the aforementioned non-aqueous solvent and another monomer component which is hardly soluble or insoluble in the non-aqueous solvent. If this is the case, the monomer component which is soluble in the above-mentioned non-aqueous solvent shows an affinity to the non-aqueous solvent, and the other monomer component which is hardly soluble or insoluble in the non-aqueous solvent shows an affinity to the particles of a colorant which particle surfaces are hydrophilic. The particles of the colorant are accordingly so wrapped with the high molecular compounds as to be dispersed in the non-aqueous solvent. Therefore, the cohesions of the particles of the colorant can be prevented and, at the same time, the dispersion stability of the particles can also be maintained. In the high molecular compounds, the monomer component which is hardly soluble or insoluble in the non-aqueous solvent is not only capable of contributing greatly to the dispersion stability and preservability of the toner particles, but also capable of displaying the charge controllability to the toner particles with the aid of ion or dipole moment. The content of the above-mentioned monomer component in the toner particles is therefore really important for image reproducibility.

Taking various kinds of high molecular compounds, the present inventors have investigated the optimum proportion of the monomer component which is hardly soluble or insoluble in the non-aqueous solvent, and they have resultantly discovered a particularly remarkable effect in the case that the above-mentioned monomer component comprises at least one kind of specific monomers each excellent in polarity controllability, such as a vinyl monomer or vinyl carboxylic acid ester monomer substituted with a substituent having a Taft's $\sigma$ value of not less than 0.45 in terms of an absolute value (i.e., $|\delta| \geqq 0.45$), and the above-mentioned monomer is present in an amount of from $2.5\times10^{-4}$ to $5.5\times10^{-4}$ mol per g of a colorant.

The inventors have also discovered that, when the above-mentioned monomer component which is hardly soluble or insoluble in the non-aqueous solvent comprises at least one kind of substituted aromatic vinyl monomers, the monomer component comprises at least one kind of the aromatic vinyl monomer each substituted with the substituent having a Hammett's $\delta$ value exceeding 0.2 in terms of an absolute value ($|\delta| > 0.2$), and that the remarkable effects can similarly be displayed by making the above-mentioned monomers present in an amount of from $2.5\times10^{-4}$ to $5.5\times10^{-4}$ mol per g of the colorant used therein. If the substituted aliphatic vinyl monomers and substituted aromatic vunyl monomers are present, the total amount of the both monomers are to be so adjusted as to be within the range of from $2.5\times10^{-4}$ to $5.5\times10^{-4}$ mol per g of the colorant.

With respect to a substituent constant, as is well-known, the more a plus factor increases, the more the electron attractive property is, and the more a minus factor increases, the electron donative property is. In a high molecular compounds, a polymerization ratio of the monomer component which is hardly soluble or insoluble in the non-aqueous solvent may be varied, when adding the monomer component in an amount of from $2.5\times10^{-4}$ to $5.5\times10^{-4}$ mol/g into the non-aqueous solvent. In practice, however, the polymerization ratios thereof are naturally limited by itself, because the high molecular compounds are to finally be dissolved in the non-aqueous solvent. When the high molecular compounds each having such a monomer polymerization ratio as mentioned above are used in toners, a remarkably less image flow or irradiation may be found in image areas, the sharpness of characters is found excellent and the characteristics are also found less deteriorated by a change on standing. Though the reason thereof is still not cleared, it may possibly be considered that the high molecular compounds each having the above-mentioned polynerization ratio are most effectively adsorbed by the adsorption site of such a colorant as carbon black and the like and such compound can so display an excellent charge controllability as to keep the charge of toner particles substantially higher because the dissociation degree or polarizability thereof is relatively higher. It may further be considered in this case that, because the above-mentioned polar monomer component is present in high molecules, it becomes possible more than in the case of using a low molecular charge controller to inhibit the charge of toner particles from the decrease in themselves caused by the desorption of the polar components from the toner particles and also to inhibit the electric conductivity of the non-aqueous solvent from the increase and further to prevent images from the bleeding caused by the leakage of charge from a charged latent image to the non-aqueous solvent and still further to improve the image reproducibility and storage stability of the liquid developer.

When using a toner containing a high molecular compound having a lower polar monomer content that the above-mentioned monomer polymerization ratio, the developing speed thereof is relatively slow and the solid density thereof is poor and, when using a toner containing a high molecular compound having a higher polar monomer content than the above-mentioned ratio, the electric conductivity of the liquid developer is increased and therefore the sharpness of characters and storage stability of the liquid developer are deteriorated.

Such high molecular compounds as mentioned above include, for example, the following copolymers:

Such monomer components as are soluble in the above-mentioned non-aqueous solvents include, for example, the monomers represented by the following Formula:

Formula [I]

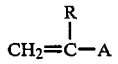

wherein R represents H, $CH_3$ or $C_2H_5$; and A represents $COOC_nH_{2n+1}$ or $OC_nH_{2n+1}$ in which n is an integer of from 6 to 20.

They may be typically exemplified by a stearyl, lauryl, 2-ethylhexyl or hexyl ester of acrylic acid or methacrylic acid; a cetyl or octyl ester of methacrylic acid; stearyl vinyl ether; lauryl vinyl ether; and the like.

The monomer components hardly soluble or insoluble in the non-aqueous solvents, which are the vinyl monomers excellent in polar controllability, such as vinyl monomers or vinyl carboxylic acid ester monomers each substituted by the substituents having Taft's aliphatic polar substituent constant value δ of not less than 0.45 in terms of an absolute value δ (i.e., $|\delta| \geqq 0.45$) or aromatic vinyl monomers substituted by the substituents having Hammett's substituent constant value $|\delta| > 0.2$); exceeding 0.2 in terms of an absolute value (i.e., $|\sigma| > 0.2$); Those include, for example, the following ethylene type unsaturated monomers;

(1) Carboxyl group-containing monomers:

Acrylic acid, methacrylic acid, crotonic acid, fumaric acid, itaconic acid, carboxystyrene and the like may typically be given as the examples thereof.

(2) Alcholic hydroxyl group-containing monomers:

δ-hydroxymethyl acrylate, β-hydroxyethyl methacrylate, β-hydroxypropyl methacrylate and the like may typically be given as the examples thereof.

(3) N-containing monomers represented by the following formula:

Formula [II]

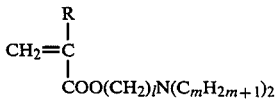

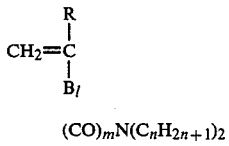

In the above-given Formula [II], R represents H or $CH_3$, l=1 to 4, and m=1 to 4; and in the Formula [III], R represents H or $CH_3$, B represents phenylene or naphthylene, l=0 or 1, m=0 or 1 and n=0 to 4.

Formula [II]typically covers, for example, dimethylaminoethyl methacrylate, diethylaminoethyl methacrylate and the like; and Formula [III] typically covers, for example, acrylamide, carbamoyl styrene, N,N-dimethylcarbamoyl styrene, amino styrene, dimethylamino styrene and the like.

(4) Sulfonic acid-containing monomers represented by the following formula:

Formula [IV]

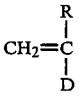

wherein R represents H or $CH_3$, andD represents $(CH_2SO_3)_{1\sim2}M$,

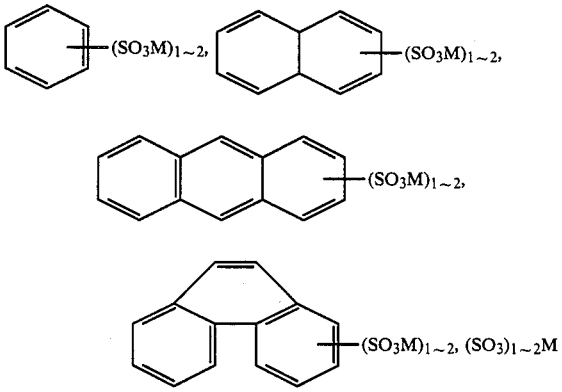

wherein M represents an alkali metal, $NH_4$ or a alkaline earth metal.

(5) Other monomers:

Glycidyl acrylate; glycidyl methacrylate; acrylonitrile; vinyl acetate; a halogenated styrene such as chlorostyrene and the like; a hydroxystyrene; an aminostyrene such as dimethylaminostyrene; vinyl imidazole; vinyl pyridine; ethylene glycol dimethacrylate; and the like. Various styrene derivatives are described in Shunsuke Murahashi et al, 'Synthetic High Molecules II', published by Asakura Book Store, Japan.

In the high molecular compounds, the monomer components each hardly soluble or insoluble in the non-aqueous solvent are also allowed to contain the other ethylene type unsaturated monomers together with those mentioned above.

They are exemplified by the following:

(1) An alkyl acrylate or alkyl methacrylate:

Ethyl acrylate, methyl acrylate, butyl acrylate, butyl methacrylate and the like may typically be given as the examples thereof.

(2) Other monomers:

Styrene, such an alkylstyrene as vinyl toluene, and the like may typically be given as the examples thereof.

In the monomeres soluble in the non-aqueous solvents and the monomers hardly soluble or insoluble in the non-aqueous solvents, one or not less than two kinds of the respective groups may be used.

The resin-component of the toners of the invention, that is the aforementioned thermoplastic resin (c), serves as a constitutional component of toner-image areas and is capable of improving not only the dispersion stability of toners and the redispersibility of a dispersion liquid, but also the image fixability to paper sheets or lithographic printing plates all the more, when the toner resins contain the thermoplastic resins (c). Such a thermoplastic resin hardly soluble or insoluble in a non-aqueous solvent at an ordinary temperature copolymer, an ethylene-methacrylic acid copolymer, an ethyleneacrylic acid copolymer, an acrylic acid resin, a methacrylic acid resin, an ester gum, a fluorine-contained resin, a vinyl chloride resin, a chlorinated polyolefin, a polyolefin, a wax, and the like. Those capable of improving the dispersion stability, image fixability and redispersibility or those for making printing plates, which are capable of improving the mechanical strength so as to make the printing durability stronger and also improving the printing ink receptivity; those preferably include, in particular, a wax and/or a polyolefin each having the softening point of from 60° to 130° C. Such particularly preferable ones may be exemplified by the following:

| Makers' name | Commodities' name | Softening point |
|---|---|---|
| | Exemplified polyethylenes: | |
| Union Carbide (USA) | DYNI | 102 |
| | DYNF | 102 |
| | DYNH | 102 |
| | DYNJ | 102 |
| | DYNK | 102 |
| Monsanto (USA) | ORLIZON 805 | 116 |
| | ORLIZON 705 | 116 |
| | ORLIZON 50 | 126 |
| Philipps (USA) | MARLEX 1005 | 92 |
| DuPont (USA) | ALATHON -3 | 103 |
| | ALATHON -10 | 96 |
| | ALATHON 12 | 84 |
| | ALATHON 14 | 80 |
| | ALATHON 16 | 95 |
| | ALATHON 20 | 86 |
| | ALATHON 22 | 84 |
| | ALATHON 25 | 96 |
| Allied Chemical (USA) | AC Polyethylene 1702 | 98 |
| | AC Polyethylene 6&6A | 102 |
| | AC Polyethylene 615 | 105 |
| Sanyo Kasei K.K. (Japan) | Sanwax 131-P | 108 |
| | Sanwax 151-P | 107 |
| | Sanwax 161-P | 111 |
| | Sanwax 165-P | 107 |
| | Sanwax 171-P | 105 |
| | Sanwax E-200 | 95 |
| | Exemplified waxes: | |
| Junsei Kagaku K.K. (Japan) | Paraffin wax | 60~98 |
| Kobayashi Kako K.K. (Japan) | Bleached Beeswax | 65 |
| | Cetanomu | 80 |
| Nagai Kako K.K. (Japan) | Bleached Beeswax | 65 |
| Seitetsu Kagaku K.K. (Japan) | Flowsen | 110 |

The above-mentioned thermoplasic resins hardly soluble or insoluble in the non-aqueous solvent at an ordinary temperature may be used independently or in combination, either. Further, if toner particles are fused by heating at the time of fixing upon developing, the interbonding property of the toner particles may be improved therebetween and at the same time the adhering property of the toner particles to an image-forming surface may also be improved.

When mixing up the above-mentioned high molecular compounds (b) and thermoplastic resins (c), the high molecular compounds (b) is mixed in in an amount of preferably from 95 to 5% by weight and more preferably from 80 to 5% by weight and the thermoplastic resins (c) is mixed in in an amount of preferably from 5 to 95% by weight and more preferably from 20 to 95% by weight, to the total amount of the resins thereof. The proportion of the mixture may variously be changed in accordance with the purposes of the final products. If the proportion thereof is within the above-mentioned range, the particles of a colorant used therein may stably be dispersed in a liquid developer so that toner images each substantially less in image flow and excellent in image sharpness can be obtained. In addition to the above, when a printing plate is prepared by making use of the above-mentioned developer, if the printing plate is of such a type that a toner image serves as a resist and non-image areas are removed by decoating the areas with such an etching liquid as an aqueous alkaline solution (hereinafter called an etching), it is preferred to contain the thermoplastic resins in an amount of from 45 to 95% by weight and the high molecular compounds in an amount of from 55 to 95% by weight, respectively, in order to avoid swelling and decoating of image area in the etching solution.

The colorants such as a pigment or dye are to be used for mainly endowing toner particles with electric charge and any generally-known colorants for liquid developers may be used for this purpose.

The above-mentioned dye include, for example, such an oil-soluble azo dye as oil-black, oil-red and the like; such a basic azo dye as Bismarck Brown, Chrysoidines and the like; such as acid azo dye as Wool Black, Amido Black-green, Blue-black HF and the like; such as direct dye as Direct Deep Black E, Congo Red and the like; such an anthraquinone dye as Sudan Violet, Acid Blue and the like; such a carbonium dye as Auramine, Malachite Green, Crystal Violet and the like; such a rhodamine dye as Rhodamine B and the like; and such a quinoneimine dye as Safranine, Nigrosine, Methylene Blue and the like.

The above-mentioned pigments include, for example, carbon black, Phthalocyanine Blue, Phthalocyanine Gree, Watchung Red, Benzidine Yellow and the like.

It is also allowed to use surface-treated pigments including, for example, carbon black dyed with nigrosine and graft carbon; silicon oxide fine powder and Microlith Blue each dyed with rhodamine; and the like.

The may be used independently or in the mixture of not less than two kinds thereof. The amount thereof to be added has a substantial influence upon their dispersion stability, adhesive property, mechanical strength, resisting property and image reproducibility and it is, therefore, preferred that they are added in an amount of not more than 50% by weight to the resin content.

The non-aqueous solvents which are to be used in the invention will serve as the dispersion medium for keeping toner particles dispersed in the charged state, and those having a relatively high insulating property and a relatively low dielectric constant may be used. Those include, for example, a petroleum aliphatic hydrocarbon or the halogen derivatives thereof. Such aliphatic hydrocarbons include, for example, n-hexane, n-pentane, isooctane, isododecane and the like. As the articles on the market, there are available, for example, Isoper-H, Isoper-G, Isoper-L and Isoper-E, i.e., isopraffin, manufactured by Exxon; Shellzole-71 manufactured by Shell; and the like. And, as the halogen derivatives of the above-mentioned aliphatic hydrocarbon include, for example, carbon tetrachloride and perfluoro ethylene. Such non-aqueous solvents as mentioned above, which are to be served as the aforementioned non-aqueous solvents, are those each having a dielectric constant of not more than 3 and a solubility parameter of not more than 8.5.

The liquid developers of the invention may also be added with such an additive as a charge-controller and an image-flow preventor, if occasion demands.

Such charge-controllers include, for example, lecithin, a metal naphthenate, an alkylbenzene sulfonate, a dialkylnaphthalene sulfonate, a mono- or di-alkylsulfo succinate, dialkyl phosphate, linseed oil, soybean oil, a natural or synthetic resin and the like.

The image-flow preventors include, for example, a relatively low molecular weight fluorine-contained resin, a relatively low molecular weight silicone, a relatively low molecular weight polystyrene, a rosin ester, a petroleum resin, saccharose acetate isobutylate and the like.

If a colorant, a charge-controller and the like may properly be selected, any positive or negative electric charged toners may freely be manufactured and used in the liquid developers of the invention.

The liquid developers of the invention can be prepared in such a manner that the aforementioned colorant (a), high molecular compound (b) and thermoplastic resin (c) are added into a non-aqueous solvent having a relatively high insulating property and a relatively low dielectric constant, and the above-mentioned additives are added thereinto if required, and the resulting matter is dispersed by making use of a ball-mill, sand-mill or colloid mill or in a supersonic dispersion method. When this is done, the high molecular compound (b) is made adhere by an adsorption or the like to the colorant serving as a disperse phase and is then dispersed into the non-aqueous solvent. In the high molecular compound (b) at this time, the monomer component thereof soluble in the non-aqueous solvent is oriented toward the non-aqueous solvent side, and the monomer component thereof hardly soluble or insoluble in the non-aqueous solvent is oriented toward the colorant particles having the hydrophilic surfaces. The dispersion stability thereof may therefore be maintained properly. In the course of making the colorant particles fine in size or the like, the colorant particles are charged and so dispersed in the non-aqueous solvent as to be wrapped up with the high molecular compound having a charge-controllability in itself. Therefore, the colorant particles display excellent dispersion stability and charge-controllability. At this time, in the toner particles which contain the monomers hardly soluble or insoluble in the non-aqueous solvent in the proprtion designated in the invention, the absorption of the high molecular compound to the colorant particles may be stabilized structurally and electrically and may also be bonded firmly thereto. Therefore, an image flow and a change on standing may be less caused.

The aforementioned thermoplastic resin (c) may be added either at the time of heating before, during or after the polymerization of the above-mentioned high molecular compound (b), or by heatedly dissolving in the non-aqueous solvent into which a part of the high molecular compound was separately added. It is also allowed to mixedly knead the resin (c) in the presence of small amounts each of the non-aqueous solvent and high molecular compound.

In the above-mentioned methods, the thermoplastic resin may be fine-grained and the dispersion thereof may also readily be performed. After the addition thereof, the dispersion may be made at an ordinary temperature or in such a state where the resin is heated at a higher temperature than the temperature applied when the resin was dissolved into the non-aqueous solvent. In the systems where the thermoplastic resin was heatedly dissolved, a uniform dispersion thereof may be accelerated in a toner liquid. After the addition thereof, or after the dispersion thereof upon heating, it is preferred to quench it with stirring. Thereby, the thermoplastic resin is deposited in the shape of fine-grains or thin-films either in the high molecular compounds or on the surfaces of the colorants and, resultantly, not only the dispersion stability and the redispersibility of toner can more be improved but also the fixability of toner images and the resistivity thereof against an etching liquid can be improved.

The liquid developers prepared in the above-mentioned manner may be differentiated according to the kinds of the colorants and further the kinds of the resins used, however, they ordinarily have a zeta potential of from 50 to 220 mV and a mobility of from $6.0\times10^{-6}$ to $2.0\times10^{-5}$ $cm^2/V.sec$. The above-mentioned values are varied according to the uses of the developers, and the physical property values of the liquid developers of the invention shall not be limited thereto.

As described above, the liquid developers of the invention are the system in which a colorant is dispersed in a non-aqueous solvent having a relatively high insulating property and a relatively low dielectric constant by making use of a high molecular compound comprising a monomer component soluble in the non-aqueous solvent and the other monomer component hardly soluble or insoluble in the non-aqueous solvent; and are capable of obtaining toner images having less image flow and excellent image sharpness, because they have substantially fine particles but have neither any excessively fine particles nor any excessively large particles still remaining therein because the dispersion thereof is not satisfactorily made.

The high molecular compounds can be adsorbed effectively and firmly to colorants and electric resistance of the solvent can also be kept lowered by polymerizing the monomer component of the high molecular compound, which is hardly soluble or insoluble in the non-aqueous solvent, in an appropriate proportion to the colorants. It is, therefore, possible to provide liquid developer so excellent in both of dispersion stability and charge-controllability, and (so) less in change on standing as to keep the images remarkably less in image-flow and image bleeding for a long time. Accordingly, it is also possible to obtain reading readable images without any stains on sheets of paper or the surface of a printing plate and any bleedings of characters. It is, further, possible to provide images excellent in sharpness without thinning characters down, using with the liquid developer for a printing plate on which non-image area is decoated by serving the toner images as the resists, if the thermoplastic resins is added to the liquid developer in proportion to not less than 45% by weight, to the total amount of the resins thereof, with the above-mentioned high molecular compounds.

EXAMPLES

Now, the preferred embodiments of the invention will be described below and, it is, however to be understood that the invention shall not be limited thereto.

Before describing the embodiments, how to prepare the high molecular compounds which are to be used in the embodiments will be described in advance.

Preparation Example 1:

A four neck flash was provided with a stirrer, a condenser, a thermometer and a dropping funnel in advance, and 100 g of isoparaffin (Isoper G) were put into the flask sealed with nitrogen and were then heated up to 70° C. The mixture solution comprising:

96 g of stearyl methacrylate,
4 g of methacrylic acid and
1 g of azobisisobutylonitrile was dropped thereinto for two hours, and 320 g of Isoper G and 4.7 g of trimethylamine were further added thereto. Thereafter, the polymerization thereof was made by heating continuously for 6 hours at 70° C., and a resin dispersion having the polymerization degree of 96.8% was obtained.

Preparation Example 2:

The mixture solution comprising:

100 g of Isoper G,
70 g of 2-ethylhexyl methacrylate,
21.5 g of methyl methacrylate,
8.5 g of N,N-dimethylaminoethyl methacrylate and
2 g of azobisisobutylonitrile was put into a flask, similar to the case of Preparation Example 1, and upon heating at 90° C. for three hours, 300 g of Isoper G and 1 g of azobisisobutylonitrile were added thereto and further heated for four hours. Resultantly, a resin dispersion having the polymerization degree of 98.5% was obtained.

Preparation Example 3:

The mixture solution comprising:

74 g of lauryl methacrylate,
6 g of glycidyl methacrylate and
100 g of Isoper G was put into a flask, similar to the case of Preparation Example 1, and upon heating at 90° C., 1.5 g of benzoyl peroxide were added thereto and the polymerization thereof was made for eight hours and then 220 g of Isoper G were further added. Resultantly, a resin dispersion was obtained. The polymerization degree thereof was 98.5%.

Preparation Example 4:

Similar to the case of Preparation Example 1, 100 g of Isoper G were taken into a flask and were then heated at 70° C. Next, the mixture solution comprising:

40 g of stearyl methacrylate,
40 g of styrene,
12 g of methyl methacrylate,
8 g of N,N-diethylaminoethyl methacrylate and
2.2 g of azobisisobutylonitrile was dropped thereinto for two hours and 300 g of Isoper G were further added thereto and, thereafter, the polymerization thereof was made by heating for six hours continuously. Resultantly, a resin dispersion having the polymerization degree of 97.5% was obtained.

Preparation Example 5:

Similar to the case of Preparation Example 1, 100 g of Isoper g were taken into a flask and was heated at 70° C. Next, the mixture solution comprising:

95.2 g of stearly methacrylate
2.2 g of methacrylic acid and
1 g of azobisisobutylonitrile was dropped thereinto for two hours, and 300 g of Isoper G and 2.6 g of triethylamine were further added thereto. Thereafter, the polymerization thereof was made by heating at 70° C. for six hours, continuously. Resultantly, a resin dispersion having the polymerization degree of 97.0% was obtained.

Comparative Preparation Example 1:

Similar to the case of Preparation Example 1, the mixture solution comprising:

100 g of Isoper G
68 g of 2-ethylhexyl methacrylate
20 g of methyl methacrylate
12 g of N,N-dimethylaminoethyl methacrylate and
2 g of azobisisobutylonitrile was put into a flask and heated for three hours at 90° C. Thereafter, 300 g of Isoper G and 1 g of azobisisobutylonitrile were added thereto and further heated for four hours. Resultantly, a resin dispersion having the polymerization degree of 98.8% was obtained.

Comparative Preparation Example 2:

Similar to the case of Preparation Example 1, the mixture liquid comprising:

100 g of Isoper G
70 g of 2-ethylhexyl methacrylate
26.4 g of methyl methacrylate and
2 g of azobisisobutylonitrile was put into a flask and heated at 90° C. for three hours. Thereafter, 300 g of Isoper G and 1 g of azobisisobutylonitrile were added thereto and further heated for four hours. Resultantly, a resin dispersion having the polymerization degree of 98.5% was obtained.

EXAMPLE 1:

The mixture comprising:

20 g of carbon black (No. MA-100, manufactured by Mitsubishi Chemical Ind. Ltd., Japan) and 240 g of Isoper G (manufactured by Exon Co., U.S.A.)

was dispersed for 30 minutes by making use of glass beads. Separately, the mixture comprising:

40 g of ethylene-vinyl acetate copolymer (No. DQDJ-7197, manufactured by Nippon Unicar CO., Japan) and 100 g of the resin dispersion prepared in Preparation Example 1 was put into a flask and dissolved by heating. Then, this mixture was added to the above-mentioned dispersed liquid while stirring at a high speed and further an appropriate amount of glass beads were so added as to be stirred and dispersed for fifteen hours. The resulted dispersed liquid was diluted 70 times with Isoper G, so that a liquid developer was obtained.

EXAMPLE 2:

The mixture comprising:

50g of the resin dispersion prepared in Preparation Example 2

20 g of carbon black surface-treated with a colorant (Nigrosine/ MA-100=1/10, manufactured by Mitsubishi Chemical Ind. Ltd. Japan) and 190 g of Isoper G was stirred and dispersed together with glass beads for 30 minutes. Separately, the mixture comprising:

40 g of polyethylene (Sanwax 171P, manufactured by Sanyo Kasei Co., Japan), 50 g of the resin dispersion prepared in Preparation Example 2 and 50 g of Isoper G was put into flask and dissolved by heating. Then, this mixture was added to the above-mentioned dispersed liquid while stirring at a high speed and further an appropriate amount of glass beads were so added thereto as to be dispersed for fifteen hours. The resulted dispersed liquid was diluted 70 times with Isoper G, so that a liquid developer was obtained.

EXAMPLE 3:

The mixture comprising:

50 g of the resin dispersion prepared in Preparation Example 3, 20 g of carbon black (MA-100, manufactured by Mitsubishi Chemical Ind. Ltd., Japan) and 150 g of Isoper G was dispersed for six hours with glass beads to make a dispersion. Separately, 40 g of polyethylene (Sanwax 171P, manufactured by Sanyo Kasei Co., Japan) were dissolve by heating in the mixture of 90 g of Isoper G and 50 g of the resin dispersion prepared in Preparation Example 3. The resulted matter was added to the aforementioned dispersion liquid, and the while liquid was dispersed for two hours with glass beads with heating at 80° C. Thereafter, the resulted dispersed liquid was quenched while stirring and was then still further stirred and dispersed with glass beads for seven hours. The resulted fnal dispersion was diluted 70 times with Isoper G, so that a liquid developer was obtained.

EXAMPLE 4:

The mixture comprising:

50 g of the resin dispersion prepared in Preparation Example 4, 20 g of Phthalocyanine Blue (Fastogen Blue GS, manufactured by Dainippon Ink Co., Japan) and 120 g of Isoper G was dispersed in the same manner as taken in Example 3. In this process, a fluorine-contained resin (Teflon K, manufactured by Mitsui Fluorochemical Co., Japan) was serves as the thermoplastic resins thereof.

EXAMPLE 5:

The mixture comprising:

20 g of carbon black (#44, manufactured by Mitsibishi Chemical Ind. Ltd., Japan) and 160 g of Isoper G was dispersed together with glass beads for 30 minutes. Separately, the mixture comprising:

20 g of ethylene-vinyl acetate copolymer (DQDJ-7197), manufactured by Nippon Unicar Co., Japan) and 200 g of the resin dispersion prepared in Preparation Example 5 was put into a flask and dissolved by heating. The resulted solution was added to the above-mentioned dispersion while stirring at a high speed and further glass beads were so added thereto as to be dispersed for ten hours. The resulted final dispersed liquid was diluted 70 times with Isoper G, so that a liquid developer was obtained.

EXAMPLE 6:

A liquid developer was prepared in the same manner as taken in Example 1, except that the resin dispersion of Preparation Example 1 used in Example 1 was replaced by the resin dispersion prepared in Preparation Example 5.

Comparative Example 1:

A liquid developer was prepared in the same manner as taken in Example 2, except that the resin dispersion of Preparation Example 2 used in Example 2 was replaced by the resin dispersion prepared in Comparative Preparation Example 1.

Comparative Example 2:

A liquid developer was prepared in the same manner as taken in Example 2, except that the resin dispersion of Preparation Example 2 used in Example 2 was replaced by the resin dispersion prepared in Comparative Preparation Example 2.

Comparative Eample 3:

The mixture comprising:

20 g of Phthalocyanine Blue (Fastogen Blue GS, manufactured by Dainippon Ink Co., Japan), 100 g of the resin dispersion prepared in Preparation Example 4 and 10 g of Isoper G was dispersed together with glass beads for six hours, and the resulted dispersion was diluted 100 times with Isoper G, so that a liquid developer was obtained. Preparation of a photosensitive solution and a printing plate:

A composite comprising:

1 part by weight of $\epsilon$-type phthalocyanine, 6 parts by weight of m-cresolphenolnovolak resin and 24 parts by weight of ethyleneglycol monoethylether was dispersed and homogenized at an ordinary temperature by making use of a supersonic disperser, so that a photosensitive solution was prepared. The resulted photosensitive solution was coated over to a coarsely finished aluminium plate so as to be 5$\mu$ in layer thickness. Resultantly, a printing raw plate was prepared. The resulted printing raw plate was so charged by a corona charger as to be imagewise exposed to light through a lens system by making use of a reflection type positive original and 10 pieces of fluorescent lamps serves as the light source, so that a static latent image was registered on the plate. The latent image was developed with the above-mentioned liquid developer and fixed by heating. Thereafter, the plate was dipped in an aqueous alkaline solution comprising sodium silicate and sodium hydroxide so as to decoat the photoconductive layer in non-image areas (whereto no toner adheres). Resultantly, a printing plate was finished. The results thereof are shown in the table below:

| | | Mol number of polar group per g of colorant | Particle-size distribution: Wt average particle size (μm) | Median (μm) | Number of particles under 0.06 μm in size (%) | Number of particles over 1.5 μm in size (%) | storage stability | Character reproducibility: Sharpness | Toner-image flow |
|---|---|---|---|---|---|---|---|---|---|
| Example of the Invention | 1 | $4.43 \times 10^{-4}$ | 0.30 | 0.42 | 2.0 | 0 | Excellent | 5 | None |
| | 2 | $5.41 \times 10^{-4}$ | 0.32 | 0.45 | 2.0 | 0 | Excellent | 5 | None |
| | 3 | $5.28 \times 10^{-4}$ | 0.27 | 0.35 | 1.0 | 0 | Excellent | 5 | None |
| | 4 | $4.32 \times 10^{-4}$ | 0.28 | 0.37 | 1.5 | 0 | Excellent | 5 | None |
| | 5 | $5.11 \times 10^{-4}$ | 0.24 | 0.32 | 3.5 | 0 | Stable for 3 months | 4~5 | None |
| | 6 | $2.55 \times 10^{-4}$ | 0.37 | 0.48 | 1.9 | 0 | Excellent | 5 | None |
| Comparative Example | 1 | $7.63 \times 10^{-4}$ | 0.28 | 0.41 | 2.2 | 0 | Stable for 1.5 months | 3 | Present |
| | 2 | 0 | 0.45 | 0.55 | 1.0 | 6.2 | Stable for 2 weeks | 3 | Numerous |
| | 2 | $4.32 \times 10^{-4}$ | 0.24 | 0.31 | 8.8 | 0 | Stable for 1 week | 2 | none |

In the Table, the evaluation of each item was made in the following manners:

(1) Dispersion stability

A developer was settled down in a test tube immediately after it had been prepared and was allowed to stand at an ordinary temperature. The sedimentation condition of each toner was judged with the naked eye and the number of months for which a sedimentation took place is indicated in the table and those not having been sedimented even after four or more months are graded therein as 'Excellent'.

(2) Sharpness in character reproduction

Sharpness was expressed in five grades by the overall evaluation of the contrast and bleeding degree of characters. Namely, 5 is the top grade, 1 is the lowest grade, 3 is an allowable grade and 2 is a grade posing a problem to use a developer evaluated.

(3) Toner-image flow

A toner image leaving a trail and particularly those causing in the character portions. This will result in a fog of non-image areas. This will not only worsen the image visibility of a toner image but also cause a background scumming on a plate even after the non-image areas are removed upon dissolving with an alkaline etching solution.

It was confirmed from the table that the liquid developers obtained were excellent in dispersion stability and polar controllability, fine and uniform in particle size, excellent in character sharpness and less in image-flow. When these plates were applied to offset printing, it was possible to print not less than 200,000 compressions.

Next, a static latent image was formed on a zinc oxide-resin dispersed type electrophotographic master in an ordinary method and was then so developed as to come out the toner image thereof with the developer prepared in Example 2, and the toner image was transferred, in a bias-roll system, to a printing raw plate comprising a grained aluminium plate coated thereon with styrene-methacrylic acid (50:50 in mol) copolymer so as to be about 3μ in thickness, and the transferred image was fixed by making use of an infrared lamp.

Successively, when the printing raw plate was etched by making use of an aqueous 2.5% sodium carbonate solution, there obtained a printing plate removed therefrom the areas where no toner adheres. The obtained printing plate was excellent in resistivity against the sodium carbonate when it was etched and remarkably sharp in character reproducibility. When the printing plate was applied to an off-set printing, it was possible to print not less than 150,000 impressions.

Next, when a static latent image was formed on a selenium photosensitive plate in an ordinary method and developed with the developer prepared in Example 4 and the resulted toner image was charge-transferred onto a sheet of transfer paper, there obtained a remarkably sharp and high density image (having an image density of 1.28 in the solid density areas thereof). In the image obtained, no stain was found in the background thereof and the sharpness and resolving power were also excellent.

Further, when the developer prepared in Example 5 was applied to a liquid development type image transfer copier, NP-6, manufactured by Canon Co., Japan, there obtained images each having the image density of 1.25, no stain in the background and excellent sharpness and resolving power.

What is claimed is:

1. A liquid developer for electrophotography, said developer comprising a non-aqueous solvent having toner particles dispersed therein, said particles comprising:

a colorant;

a high molecular compound produced in a non-aqueous medium by polymerization of a first monomer component, said first component being soluble in said non-aqueous solvent and being represented by general formula 1

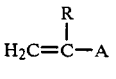

wherein R is selected from H, $—CH_3$, and $—C_2H_5$,

A is selected from $—COOC_nH_{2n+1}$ and $—OC_nH_{2n+1}$, n being an integer of from 6 to 20, and a second monomer component insoluble or slightly soluble in said aqueous solution, said second component being at least one monomer selected from vinyl monomers and vinyl carboxylic acid monomers, provided that the monomers are substituted with a substitutent so that Taft's aliphatic polar substituent constant $\sigma$ is not less than 0.45 in absolute value, and said high molecular compound is present in an amount of from $2.5\times10^{-4}$ to $5.5\times10^{-4}$ mols per gram of said colorant and;

a thermoplastic resin selected from the group consisting of waxes, polyolefins, and mixtures thereof, which is insoluble or slightly soluble in said non-aqueous solvent at ordinary temperatures, wherein said thermoplastic resin comprises from 5 to 95% of the total amount of said high molecular compound and said thermoplastic resin, and the number of toner particles having a diameter less than 0.06 μm is not more than 5%, and the number of particles exceeding 1.5 μm in diameter is not more than 3%, both based on the total number of toner particles.

2. The developer of claim 1 wherein said thermoplastic resin comprises from 45 to 95% of the total amount of said high molecular compound and said thermoplastic resin.

3. The liquid developer of claim 1, wherein said second monomer component is at least one aromatic vinyl monomer substituted with a substituent of which Hammett's substituent constant $\sigma$ exceeds 0.2 in absolute value ($|\sigma\equiv1| > 0.2$), and an amount of said monomer component is from $2.5\times10^{-4}$ to $5.5\times10^{-4}$ mol per gram of said colorant.

4. The liquid developer of claim 1, wherein said thermoplastic resin is selected from wax and polyolefin.

5. The liquid developer of claim 1, wherein the content of said high-molecular compound is from 5 to 80% of the total amount of said high-molecular compound and said thermoplastic resin.

6. The liquid developer of claim 5, wherein the content of said high-molecular compound is from 5 to 55% of the total amount of said high-molecular compound and said thermoplastic resin.

7. The liquid developer of claim 1, wherein said non-aqueous solvent is selected from an aliphatic hydrocarbon and a halogen-substituted aliphatic hydrocarbon.

* * * * *